United States Patent [19]

Lee

[11] 4,254,487

[45] Mar. 3, 1981

[54] ELECTRONIC TIME PIECE

[76] Inventor: Shu-Tso Lee, 1927 Park Dale La., Encinitas, Calif. 92024

[21] Appl. No.: 49,938

[22] Filed: Jun. 18, 1979

[51] Int. Cl.[3] ..... G04B 19/24; G04C 17/02; G04C 19/02

[52] U.S. Cl. ..... 368/29; 369/240

[58] Field of Search ..... 58/127 R, 50 R, 42.5, 58/4 A; 368/240, 29

[56] References Cited

U.S. PATENT DOCUMENTS

| | | | |
|---|---|---|---|
| 3,754,392 | 8/1973 | Daniels | 58/50 R |
| 3,823,549 | 7/1974 | Feldman | 58/50 R |
| 3,955,354 | 5/1976 | Kilby et al. | 58/50 R |
| 4,007,583 | 2/1977 | Johnson | 58/50 R |
| 4,044,545 | 8/1977 | Shimizu | 58/42.5 |
| 4,072,005 | 2/1978 | Teshima et al. | 58/42.5 |

*Primary Examiner*—J. V. Truhe
*Assistant Examiner*—John B. Conklin
*Attorney, Agent, or Firm*—Frank D. Gilliam

[57] ABSTRACT

An electronic timing device having first individual visual display elements numbering sixty positioned to resemble the seconds and/or minutes of a conventional clock, second individual visual display elements numbering twelve positioned for resembling the hour position of a conventional clock, third individual visual display elements numbering seven and representing the seven days of a week and a logic circuit included to provide for sequentially displaying the second, minute and/or date on the first visual display elements, for sequentially displaying the hour and/or the month on the second visual display elements, displaying the day of the week on the third visual display elements for displaying AM or flashing the third indicating visual elements for indicating PM. An (optional) feature provides a selection of time in various selected different time zones.

20 Claims, 8 Drawing Figures

12
28
12
34
36
38
12
12
20
30
28
DEC
JAN
NOV
OCT
FEB
SEPT
MAR.
AUG
JULY
JUNE
MAY
APR.
S M T W T F S
JAPAN EAST
EAST EUROPE
MOSCO 20
24
12
12
24
12
12
NOV.
DEC.
JAN
FEB
OCT.
SEPT.
MAR.
AUG
APR.
JULY
JUNE
MAY
S M T W T F S
JAPAN
LA
NY
MOSCO
EGYPT

T
U
366
368
DEBOUNCE CIRCUIT
370
372
378
382
B
374
378
380
384
A
388
386
D
V
W
SAME CIRCUIT
C

66
CL
Q3
Q4
Q5
Q6
R
68
1Hz
70
CLK Q1
Q2
Q3
Q4
Q5
Q6
R
SEB
78
74
75
TO AUTO
MHEB
80
73
72
51
CLK Q2
56
+V
54
52
76
MDEB
48
106
104
SET
53
56
152
46
164
44
42
40
154
156
158
162

ELECTRONIC TIME PIECE

BACKGROUND OF THE INVENTION

The invention generally relates to a timing device and more specifically to an electronic solid state timing device that electro-optically displays seconds, minutes, hours, day of the month, day of the week, month and (when required) displays AM and PM either sequentially or selectively and selectively provides the correct time and day of the week of a plurality of different time zones around the world.

Some of the existing solid state timing devices are taught by the following U.S. Pat. Nos.:

3,844,105 teaches the use of two rings of sixty indicating elements. One ring displays the hour and the other two rings cooperating indicate the minute. There are no other features provided for in this device.

3,889,458 teaches a combination of an analog and a digital display. The digital display provides the hour and minute in one mode and the date in another mode. The analog display indicates the day of the week in one mode and ten second indications in the other mode. There are no other features provided for in this invention.

3,922,847 teaches only three functions, namely, hour, minute and seconds. The time indicator means is an inner ring of twelve display elements with one continuously energized to indicate the hour, a second outer ring of sixty display elements, one of which is continuously energized to indicate the minute and one which is energized in a pulsating manner to indicate the second.

3,955,350 teaches a single ring of sixty indicators for indicating the hour, minutes and seconds. The seconds are stepped and displayed in one second intervals around the sixty indicators, the minute is stepped around the clock at sixty second intervals and is energized every two seconds and the hour is stepped every sixty minutes and is continuously energized.

3,962,858 teaches a timing device having certain available outputs, namely seconds, minutes, hours, days of the month in a sequential order. Although no display means is claims, it is taught that a single display means may be utilized for these displays.

9,986,333 teaches means for displaying hours, minutes and/or seconds only, no other indications are taught.

4,007,583 teaches the use of a single ring of twelve indicators. The hour indication is held constant, the minutes are displayed in the five minute positions of a normal clock, the month and days are indicated by modulating the energizing of the ring of twelve indicators at various frequencies. This device is quite hard to read specifically with multi-different frequencies.

4,041,692 teaches the use of two 60 LED matrixes and an additional 12 LED matrix. There are no teachings to provide selective time zone around the world.

These teachings do not provide the number of different functions nor the ease or reading of the display for the various functions as does the device of the instant invention.

SUMMARY OF THE INVENTION

The instant invention provides a unique electronic time piece that is completely automatic and constantly displays four basic time functions which appear to be displayed simultaneously, provides an AM-PM indication, three separate functions by command and additionally provides means for operator selection of one time zone from a plurality of different world time zones with the capability of self-return to the local time of the day for which the time piece is originally programmed.

DETAILED DESCRIPTION OF THE PREFERRED EMBODIMENT

The invention pertains to an improved electronic watch, clock, calendar or the like for selectively indicating the second, minute, hour, date, day of the week, month of the year and PM or AM, with the additional capability of selectively indicating a plurality of different time zones throughout the world.

In the preferred embodiment, the viewing area of the timing device of the instant invention takes the form of a conventional or traditional clock with an electro-optic display. For wristwatch sizes and the like, liquid crystal displays known in the art as LCD's are generally utilized for the display means principally because of their powerdrain characteristics. Larger clocks of the type that are installed or permanently displayed in business buildings, offices, homes and public places and the like, generally utilized light emitting diodes known in the art as LED's or the like because of the fact that the size and weight of a power supply and its power consumption is not a principal consideration in the design of the timing device. The seconds and minutes of the device of the instant invention are displayed simultaneously on the same sixty electro-optic devices by convenient time sharing demultiplexing technique. The conventional placement of the twelve electro-optic devices indicate the twelve hour positions and additionally display the month of the year. The first thirty-one of the sixty electro-optic devices further selectively display the day number of the date. Seven electro-optic devices provide the day of the week. AM or PM is selectively identified by either a steady for AM or a flashing for PM display of the weekday electro-optic devices.

An additional feature provides manual selection of one of a plurality of different available time zones throughout the world with respect to the operator's local time zones.

Throughout the description of the specific embodiment, specific electronic components will be called out and with connections as identified by their specific manufacturer. It should be understood that any manufacturer's device having the same or similar electronic characteristics may be substituted therefore in a known manner either as described herein or as would be well-known in the electronic art. Although all manufacturers do not use the same connection identifying nonmenclature, a person with knowledge in this art would be able to cross-reference any similar device with the following detailed description when taken with the figures of the devices used herein and connect them in a suitable manner to practice this invention.

Figure 1:
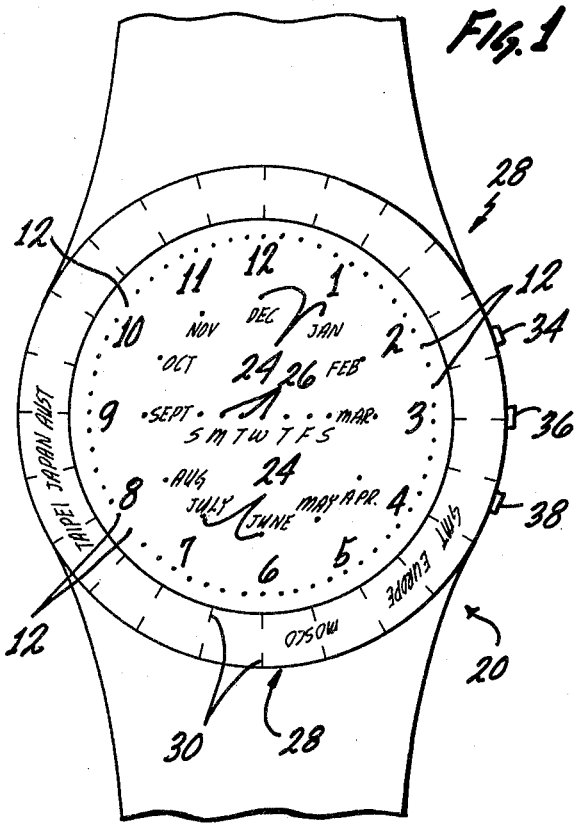
FIG. 1 is a showing of one embodiment of the instant invention.

Referring now to FIG. 1, which shows the device taking the form of a wristwatch or the like, the watch device 20 is shown in this form for ease of description and explanation as most people throughout the world are familiar with time-keeping devices taking this conventional circular form. A first plurality of electo-optical indicators 12 (sixty in number) are equally spaced and positioned to form an approximate circle for displaying the seconds, minutes and number of the day of the month (date). A second plurality of indicators 24, twelve in number, also equally spaced in a similar circuit fashion for indicating the hour of the day and the month of the year. A third plurality of electro-optical indicators 26, seven in number, are equally spaced and shown to be in a line having a normally horizontal plane and indicate the name of the day of the week. These indicators 26 may be covered by stencil or the like in the shape of the first letter or the abbreviation of the day of the week it represents. Typically, they would be arranged resembling the conventional calendar, i.e. Sun for Sunday positioned in the most left-hand side and Sat, Saturday, in the most right-hand side. A bezel 28 is positioned at the outer periphery of the watch device 20 and is rotatable with respect to the center portion of the watch 20. Sequentially positioned around the bezel 28, there are twenty-four reference indicators 30 each denoting a different time zone around the world. It should be noted at this point that the number of indicators 30 is chosen merely to show the operation of the device, any number less than 24 could be utilized depending on the physical size of the device. On the base of the watch device 20 and positioned in a selected position near the bezel 28, is a reference indicator 32 positioned for alignment with one of the plurality of reference indicator 30 to denote the proper position of the bezel 28 for that selected world time zone desired. It should be understood that the undersurface of the bezel 28 there are positioned a plurality of contact switches that are closed and opened with the turning of the bezel. This feature will be hereinafter described in greater detail. Manually operated switches normally of the momentary push-button type could be utilized equally as well for this purpose when used with a larger stationary time device.

Figure 2:
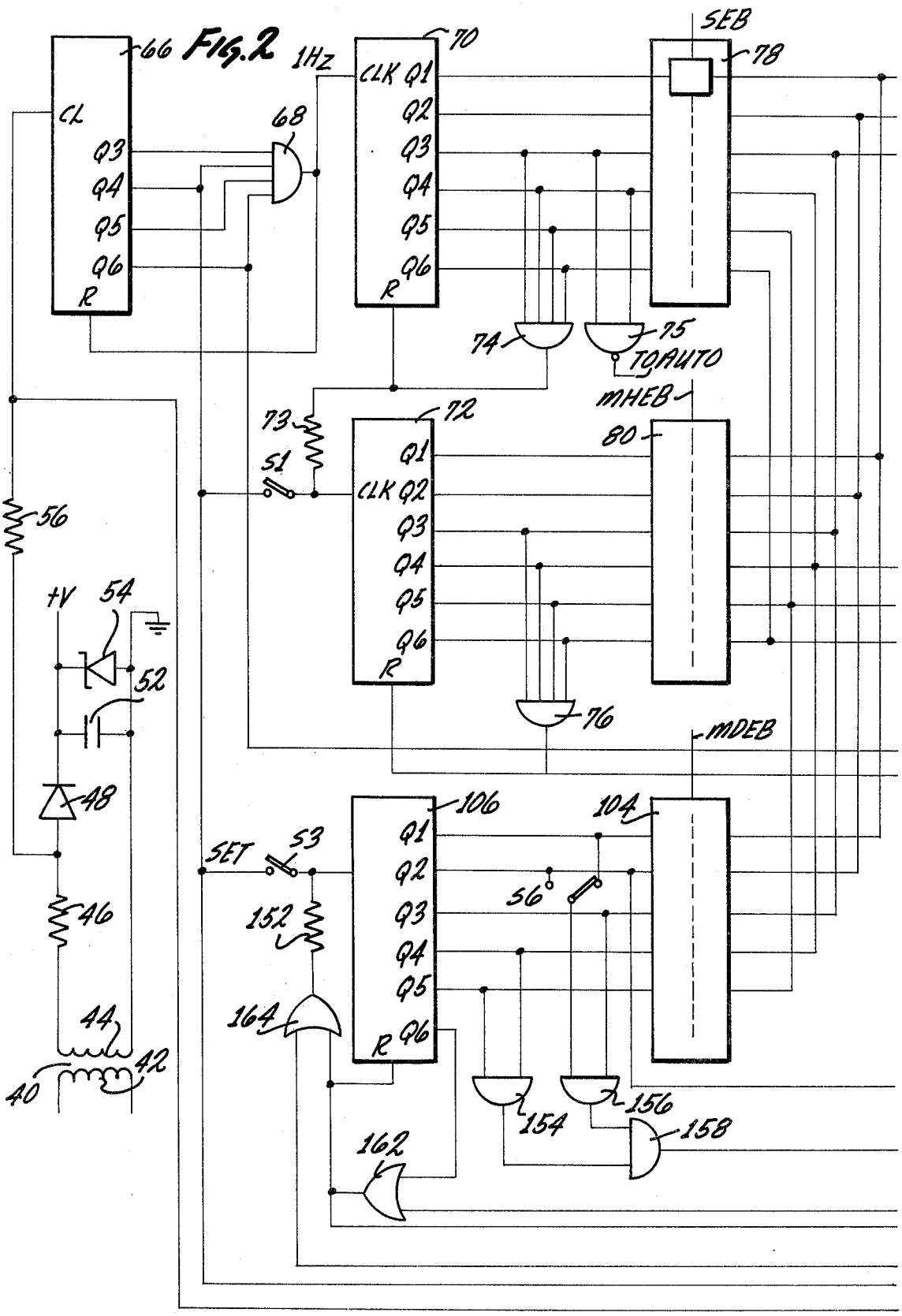
FIG. 2 is a partial schematic showing of the electronic time piece of the invention.

Referring now to FIG. 2, for convenience of explanation, the power source for this device is shown as a conventional 60 Hz convenient AC wall outlet. It should be understood that for use in wrist-watches or similar portable timing devices that batteries may be used as a source of power with a frequency device local oscillator such as a divide-by-32,768 counter producing a 1 Hz clock signal well known in the watch art may be utilized. A stepped-down transformer 40 is utilized to lower the voltage from that of a conventional outlet to a usuable voltage for this device. The secondary winding 44 of the transformer 40 has one end connected to ground and the other end connected to a current-limiting resistor 46 of a value selected to limit the system current which is determined by those electronic components utilized. A conventional powered diode or rectifier 48 has its anode element connected to the resistor 46 and its cathode element connected to the various electronic devices requiring the voltage V+ for their operation. The cathode element supplying the V+ has two parallel paths to ground, one through a capacitor 52 and the other through a zeiner diode 54 for filtering and setting the maximum level of V+. A resistor 56 for current limiting is connected in series between the resistor 46 and the clock or CL input of a divide-by-sixty counter 66. Obviously if the convenience outlet provided a different frequency a suitable divide down counter would be used, for example, a divide-by-fifty counter if the frequency was 50 Hz etc. The hereinbefore described power supply provides a sixty Hz square wave signal at CL and a D.C. output voltage at V+. The divide-by-sixty counter is a six bit binary counter with outputs Q3, Q4, Q5, and Q6 connected to the four inputs of AND gate 68. The output of AND gate 68 is connected to the reset R of counter 66. The outputs of counter 66 Q3, Q4, Q5 and Q6 have binary values of 4, 8, 16 and 32 respectively, and at the instant these outputs are at their high level, a reset pulse is produced at the output of AND gate 68 which resets the counter 66 to its zero count, and removing the high level of output of AND gate 68. The counter 66 with AND gate 68 will therefore count from zero or sixty ($4+8+16+32=60$) to fifty-nine in a repetitious fashion when supplied with a 60 Hz square wave clock on terminal CL resulting in a narrow pulse being produced at the output of AND gate 68 with a repetition rate of one pulse per second or one Hz.

Two additional divide-by-sixty counters, binary counter 70 with decoder, AND gate 74 and binary counter 72 with the decoder AND gate 76, are identified in every respect with previously described counter 66 with decoder AND gate 68. The one Hz clock from the output of AND gate 68 to the input CL of binary counter 70 thus results in one pulse per minute on the output of AND gate 74. The output of AND gate 74 is connected to the clock input CL of binary counter 72 through a resistor 73. The clock input to binary counter 72 is also connected to a normally open switch S1 whose other contact is connected to Q4 binary counter 66. While switch S1 is open, the output pulse from AND gate 74 is presented to the clock input CL of binary counter 72 thus producing one pulse per hour at the output of AND gate 76. The six outputs of counter 70 (Q1 through Q6) represent the seconds' status of each minute, and the six outputs of counter 72 represent the minutes' status of each hour. Additionally connected to Q3 and Q4 outputs of binary counter 70 is a NAND gate 75 which has its output connected to one contact of single pole double through switch S5 hereinafter referred to in more detail.

Transmission gates 78, 80 and 104 are controlled by gating signals SEB, MHEB and MDEB respectively, the source of which are hereinafter discussed. Each transmission gate 78, 80, 104 when provided with a high gate signal will provide a path for its input singals to the output terminals, and when provided with a low gate signal, will interrupt the signal paths and act as an open circuit.

Transmission gate 78 receives its input Q1 through Q6 from binary counter 70, and when enabled presents same inputs to its output terminals. Likewise, transmission gate 80 receives its input Q1 through Q6 from binary counter 72, and when enabled, presents these signals at its output terminals.

Transmission gate 104 receives its input Q1 through Q5 from binary counter 106, which will hereinafter be described, and when enabled presents its input signals to its output terminals.

The outputs of transmission gates 78, 80 and 104 are connected in parallel such that the output terminals corresponding to Q1 of binary counters 70, 72 and 104 are connected together, the outputs corresponding to Q2 are connected together, the outputs corresponding to Q3 are connected together, the outputs corresponding to Q4 are connected together, the outputs corresponding to Q5 are connected together, and the two outputs for Q6 (from 70 and 72, respectively) are connected together.

By selectively controlling the gating signals of transmission gates 78, 80 and 104, either of the outputs of binary counters 70, 72 or 106 will be present on the common output of transmission gates 78, 80 and 104. Q1, Q2 and Q3 from the output of transmission gates 78, 80 and 104 are connected to inputs A, B and C respectively of demultiplexer 82. Q4, Q5 and Q6 from the output of transmission gates 78, 80 and 104 are connected to inputs A, B and C respectively of demultiplexer 84.

Demultiplexers 82 and 84 each have 8 channel outputs which are connected in a matrix 88 with light emitting diodes LED as described below:

Channels 1 through 4 of demultiplexer 82 are each connected to the anode elements of eight LED's, and channels 5 through 8 are connected to the anode elements of seven LED's.

Channel 1 of demultiplexer 84 is connected to the cathode elements of first diode in each channel output of demultiplexer 82.

Channel 2 of demultiplexer 84 is connected to the cathode element of the second diode in each channel output of demultiplexer 82. Channel 3 and demultiplexer 84 is connected to the cathode element of the third diode in each channel output of demultiplexer 82. Channel 4 of demultiplexer 84 is connected to the cathode element of the fourth diode in each channel output of demultiplexer 82. Channel 5 of demultiplexer 84 is connected to the cathode element of the fifth diode in each channel output of demultiplexer 82. Channel 6 of demultiplexer 84 is connected to the cathode element of the sixth diode in each channel output of demultiplexer 82. Channel 7 of demultiplexer 84 is connected to the cathode elements of the seventh diode in each channel output of demultiplexer 82. Channel 8 of demultiplexer 84 is connected to the cathode elements of the eight diode in the remaining four output channels of demultiplexer 82.

Demultiplexer 82 has its common switch connection connected to V+. Demultiplexer 84 has its common switch connection connected to ground.

By selectively controlling inputs A, B and C of demultiplexers 82 and 84, any LED in the matrix 88 may be illuminated by providing a signal path from V+ to the output channel selected on demultiplexer 82 through the LED connected to the output channel selected on demultiplexer 84, and then to ground.

The matrix 88 will show the status of the selected binary counter 70, 72 or 106 as determined by the gating signals SEB, MHEB or MDEB by selected path through transmission gates 78, 80 or 104. The selected counter being decoded by demultiplexers 82 and 84, and thereby causing the appropriate LED in matrix 88 to be turned on.

By selecting for display the status of the binary counters 70 and 72 by (alternatively) enabling the transmission gates 78 and 80 in a rapid (60 Hz) rate, the display matrix 88 will show the corresponding appropriate LED's turned on simultaneously, as the rapid flicker can not be seen by the human eye. As should now be understood, matrix 88 will appear to display seconds and minutes simultaneously. In a different mode, hereinafter discussed, the seconds and minutes will be removed from the matrix 88 and the date of the month will be displayed in place thereof by disabling transmission gates 78 and 80, and enabling transmission gate 104 which derives its signals from the date binary counter 106.

The hour pulse generated by AND gate 76 supplies one input to each of two OR gates 90 and 92. The second input to these last mentioned OR gates will be hereinafter discussed. The hour pulse signal passes through OR gate 92 when the second input A to same OR gate is in a low state and supplies the clock input CLK to a 4 bit up/down counter 94. The hour pulse likewise passes through OR gate 90 providing its second input B is in a low state and supplies inputs to P1, P2 and P4 through inverting gate 91 and directly to up/down control input of counter 94. Input P3 of same counter is tied to the ground. Normally, the second input B to OR gate is in a high state, thereby providing a high level on the up/down control input to counter 94 and low inputs to P1, P2 and P4, causing the counter (in the counting-up mode with initial states of 0000) to advance one count every hour. AND gate 96 has one input connected to Q3, and the second input connected to Q4 of counter 96, and when both Q3 and Q4 are in a high state which occurs at the count of $12(4+8=12)$, a high level is produced at the output of AND gate 96. The output of AND gate 96 is connected to the reset R input of counter 94, and to one input of OR gate 100. The high level produced by AND gate 96 causes the counter 94 to reset to zero count, thus removing the high level on outputs Q3 and Q4, and causes the output of AND gate 96 to 90 low again resulting in a short pulse on its output every 12 hours. The binary outputs Q1 through Q4 of counter 94 thus represent the status of the hour.

Weekday counter 98 is also a four bit up/down counter. Normally, the up/down control input to this counter is in a hgh state as controlled by an input signal D hereinafter described. The signal D is inverted through inverting gate 108, and provides a normally low signal on inputs P1, P3 and P4 of counter 98. Input P2 of same counter is tied to ground. The clock CLk input to counter 98 is connected to a normally open switch S2, and to a resistor 110. The other side of the resistor 110 is connected to the output of OR gate 100, thus providing a path for the 12 hour pulse to the clock input to counter 98, when the second input to OR gate 100 is low as controlled by C hereinafter discussed. Because the counter 98 is clocked at each 12 hour interval, the first bit Q1 represents the half day status, or AM when in a low state and PM when in a high state. Q2, Q3 and Q4 represent the weekday status of the counter. A reset is provided for from the count of 7 by way of transmission gate 112 and demultiplexer 102 when it is in state 7 which is decoded into output channel 8 and fed to the reset line of counter 98 causing it to reset to zero and remove the state 7 which caused the reset signal to occur.

Transmission gates 116, 114 and 112 are transmission gates similar to 78, 80 and 104 except for the plurality of channels. The inputs of transmission gate 116 are connected to bits Q1 through Q4 of counter 94; the inputs of transmission gate 114 is connected to bits Q1 through Q4 of counter 118, hereinafter discussed, and the inputs of transmission gate 112 is connected to bits Q2 through Q4 of counter 98.

The outputs of transmission gates 116 and 114 are connected in a manner such that the outputs corresponding to Q1 of counter 98 and Q1 of counter 118 are connected together, and to an inverting gate 120. The outputs of transmission gates 116, 114 and 112 corresponding to the output bits Q2 of counters 94, 118 and 98 are connected together, and to input A of demultiplexer 102. The outputs of transmission gates 116, 114 and 112 corresponding to bits Q3 of counters 94, 118 and 98 are connected together and to input B of demultiplexer 102. The outputs of transmission gates 116, 114 and 112 corresponding to bits Q4 of counters 94, 118 and 98 are connected together and to input C of demultiplexer 102.

It is understood that by selective control of control inputs MHEB, MDEB or WKEB of transmission gates 116, 114 or 112 respectively, the outputs of counters 94, 118 or 98 are selectively transmitted through respective transmission gates to this common input.

Transmission gates 116 and 112 are enabled alternatively at a 60 Hz rate using the same control signal for transmission gate 116 as for transmission gate 80, and using a different, but synchronous, signal to transmission gate 112. Therefore, the display of hour and weekday will be synchronous to the display of minute and second respectively. Because of the 60 Hz sample rate, resulting flicker is not perceivable by the human eye and resulting display appears continuous.

A second LED matrix 124 contains 19 light emitting diodes. Output channels 1 through 6 of demultiplexer 102 is connected to the anode elements of three LED's each. Output channel seven is connected to the anode element of one LED.

The cathode elements of the first LED in output channels 1 through 6 are connected together, and to transmission gate 126. The cathode elements of the second LED in output channels 1 through 6 are connected together and to transmission gate 122.

The cathode element of the third LED in output channels 1 through 6 are connected together and to transmission gate 128. Additionally, the cathode element of the LED in output channel 7 is connected to transmission gate 128.

The first two columns in LED matrix 124 are used to display both the hour status and the month status. The third column is used to display the weekday status.

Demultiplexer 102 is identical to demultiplexer 82, and has V+ connected to its common terminal. The address lines A, B and C to demultiplexer 102 are derived from outputs of transmission gates 116, 114 and 112, and will for selective address states cause appropriate LED's in matrix 124 to become energized.

Transmission gates 126, 122, 130 and 128 are single channel transmission gates, providing a conduction path from V+ through the addressed LED in matrix 124 to ground when appropriately selected. Transmission gate 126 has its control input connected to the output of inverting gate 120, and its output to the input of transmission gate 130. Thus, both transmission gates 126 and 130 must be enabled for conduction to ground to occur. Similarly, the control of transmission gate 122 is connected to the input of inverting gate 120, and its output of transmission gate 130. Both transmission gates 122 and 130 must be enabled in order to provide a conduction path to ground. It is observed that either transmission gates 126 or 122 are enabled at any instant as controlled by LSB output of transmission gates 116 or 114 and inverting gate 120.

Transmission gate 130 is controlled by the same 60 Hz clock as counter 66, and transmission gate 128 is controlled by the same signal as transmission gate 112. The transmission gates 130 and 128 are enabled alternatively, resulting in alternate displays of hour/month status and weekday status. Again, because of the fast selective enable rate, the resutling display appears continuous.

One side of resistor 150 is connected to V+. The other side of resistor 150 is connected to one input of AND gates 136, 138, 140 and to the wiper contact of switch S5 and inverting gate 144. The other contact of switch S5 is connected to ground. The output of inverting gate 144 is connected to one input of AND gate 142.

The second input AND gate 136 is tied to control signal B. The second input of AND gates 138 and 142 are connected to the 60 Hz clock same as the control input to transmission gate 130 and counter 66. The second input to AND gate 149 is connected to one input of AND gate 134, and to the output of inverting gate 146. The input of inverting gate 146 is connected to the 60 Hz clock same as counter 66. The second input of AND gate 134 is connected to the output of OR gate 132. One input to OR gate 132 is connected to the output of AND gate 136. The second input to OR gate 132 is connected to the output of NAND gate 133. One input of NAND gate 133 is connected to Q6 of counter 66. The second input to NAND gate 133 is connected to Q1 of counter 98 and to the transmission gate 148. The control input to the transmission gate 148 is tied to control signal E.

Normally, switch S5 is open, thereby enabling one input of each of the AND gates 136, 138 and 140. A high level on the input of inverting gate 144 causes AND gate 142 to have a low output state. The 60 Hz clock input to inverter 146 and AND gate 138 causes the outputs of AND gates 138 and 140 to alternate between high and low states at a 60 Hz rate; the output MHEB of AND gate 138 being in phase with the 60 Hz clock, and the output SEB of AND gate 140 being of opposite phase, or inverted.

The low state of AND gate 142 disables transmission gates 104 and 114, thereby preventing date counter 106 and month counter 118 from being displayed. The transmission gate 78 and 80 are alternatively enabled by SEB and MHEB respectively, causing the display of second status and minute status alternatively at 60 Hz rate on LED matrix 88.

Likewise, for a normal high level of the control signal B, OR gate 132 has a high level output, causing AND gate 134 to have an inverted 60 Hz clock output WKEB same as that present on output of AND gate 140. Transmission gate 112 and 116 are therefore alternatively enabled same as transmission gates 78 and 80, causing a display of weekday counter 98 and hour counter 94 alternatively with the weekday being displayed while the output of AND gate 134 is in a high state, and the hour being displayed while the output of AND gate 138 is in a high state.

To display the month and date, the switch S5 is switched to the ground contact, causing AND gates 136, 138 and 140 to have low state outputs, and causing converting gate 144 to have a high state output thereby enabling AND gate 142. The output MDEB of AND gate 142 now has the 60 Hz clock output same as its second input. The output of AND gate 136 is in a low state presenting a low input to OR gate 132. The second input to OR gate 132 is derived from the output of NAND gate 133 which receives its inputs from Q1 of counter 98, and Q6 of counter 66. When Q1 of counter 98 is in a high state which occurs during the second 12 hour interval, or PM, Q6 of counter 66 will be transmitted to the output of NAND gate 130 in inverted form. This one second period square wave is transmitted through OR gate 132, and combined with the second input in AND gate 134 resulting in 60 Hz output signal during the one half second high state of OR gate 132, and a low state output for the one half second low state output of OR gate 132. During the low state of Q1 of counter 98, or AM, the output of NAND gate 133 is in a high state, which causes the output of OR gate 132 to have a high state output thereby enabling AND gate 134, and causes a continuous 60 Hz signal from its second input to become transmitted to its output. Transmission gates 114 and 104 are enabled from the output signal of AND gate 142, and likewise transmission gate 112 is enabled from the output signal from AND gate 134. As these outputs are of opposite phase and at 60 Hz rate, the result is that transmission gates 114 and 104 are enabled simultaneously and alternatively from transmission gate 112. Thus date/month is displayed alternatively to the display of weekday. During the display time for weekday, the display will flash at a one second rate if it is PM, but will be steady if it is AM. The 60 Hz selective clock rate eliminates perceivable flicker, but the one second rate permits pulsating display of the weekday during PM.

To display the second, minute and hour alternatively with the date and month S5 is switched to its other contact. In this position the input of AND gate 136 is connected to the output of NAND gate 75. When Q3 and Q4 of binary counter 70 are high the output of NAND gate 75 will be low. This will occur at 12, 13, 14, 15, 28, 29, 30, 31, 44, 45, 46 and 47 second counts. Therefore the output of NAND gate 75 will go low three times every minute for a four second duration. The date and month will be displayed when the output of NAND gate 75 goes low and at all other times the second, minute and hour will be displayed.

Date counter 106 is a six bit binary counter. The clock input to counter 106 is connected to switch S3 and resistor 152. The other side of resistor 152 is connected to the output of OR gate 164. Outputs Q1 through Q5 of counter 106 are connected to the inputs of transmission gate 104. A single pole double throw switch S6 has one terminal connected to Q1 of counter 106, and the other terminal connected to Q2 of same counter. The common switch terminal of S6, normally being toggled to the Q1 side, is connected to one input of AND gate 156. The second input to AND gate 156 is connected to Q3 of counter 106. AND gate 154 has one input connected to Q4, and the second input connected to Q5 of counter 106. The output of AND gate 156 is connected to one input of AND gate 158. The output of AND gate 154 is connected to the second input of AND gate 158. The output of AND gate 158 is connected to one input of AND gate 160. Q1 of counter 118 is connected to inverting gate 178 and to one input of ANd gate 172. Q2 of counter 118 is connected to one input of AND gate 176. Q3 of counter 118 is connected to one input of AND gate 184 and to inverting gate 180 and one input of AND gate 174. Q4 is connected to the second input of AND gate 184, and to inverting gate 182 and the second input to AND gate 172. The output of AND gate 184 is connected to the reset R of counter 118. The ouput of inverting gate 178 is connected to the second input of AND gate 176, and to the second input of AND gate 174. The output of inverting gate 180 is connected to the third input of AND gate 176. The output of inverting gate 182 is connected to the fourth and last input of AND gate 176. The output of AND gate 176 is connected to one input of OR gate 166. The output of AND gate 174 is connected to one input of OR gate 170. The output of AND gate 172 is connected to the second input of OR gate 170. The output of OR gate 170 is connected to one input of AND gate 168. The second input to AND gate 168 is connected to Q2 of counter 106. The output of AND gate 168 is connected to the second input of OR gate 166. The output of OR gate 166 is connected to the second input of AND gate 160. The output of AND gate 160 is connected to one input of OR gate 162. The second input of OR gate 162 is connected to Q6 of counter 106. The output of OR gate 162 is connected to the clock input of counter 118, and to the reset R of counter 106 and one input of OR gate 164. The second input to OR gate 164 is connected to the output of AND gate 148.

Counter 118 is a four bit binary counter used as a month counter. The count of 12 is decoded by AND gate 184, which causes a high signal on its output, corresponding to a high level of Q3 and Q4 of counter 118, and to cause a reset of the same counter thus removing the two high states at outputs Q3 and Q4, thus causing a narrow pulse at the output of AND gate 184 every 12 months. The third state of counter 118 is decoded by inverting gates 178, 180 and 182, and AND gate 176. In this state only Q2 is in a high state providing a direct enable to AND gate 176. The low states of Q1, Q3 and Q4 are inverted, and therefore AND gate 176 has four inputs with high state signals, and produces a high state signal on its output respresenting the month of February. This signal is transmitted through OR gate 166 to AND gate 160. AND gates 154, 156 and 158 decode the count 29 of counter 106, at which time the second input to AND gate 160 goes to a high state causing a high state at the output of OR gate 162, causing in turn the counter 106 to be reset, and the counter 118 to advance one count. The month counter 118 is therefore advanced on the 29th day of the month of February and the day counter 106 reset to zero. The reset pulse to counter 106 is also presented to the clock input of same counter, causing it to advance to a count of one. (First day of the month)

There are only two states of counter 118 where Q1 is in a low state while Q3 is in a high state. These are the 4th and 6th counts, or April and June, respectively. These months are decoded by AND gate 174. Conversely, there are only two states of counter 118 where both Q1 and Q4 are high. These are the 9th and 11th counts representing September and November, respectively. These states are decoded by AND gate 172.

In April, June, September and November, therefore, OR gate 170 will have one high level input resulting in a high level output to AND gate 168. AND gate 168 receives its other input from Q2 in the date counter, and when Q2 is high, produces a high level to OR gate 166 causing it to present a high level to AND gate 160. When the second input to AND gate 160 is high, a count of 31 is accumulated, 29 plus 2=31, and the AND gate 160 produces a high level output to one input of OR gate 162, while the other input of OR gate 162, or Q6 of the counter 106, is low, causing advance of month counter reset of the date counter to zero, then advance the date counter to one as previously described.

Where neither of above conditions exists, the date counter 106 counts to 32, when Q6 goes to a high state, causing a high level input to OR gate 162 thereby producing a high level output on OR gate 162 which resets counter 106, and advaces month counter 118 then advances the counter 106 to one. Switch S6 is normally connected such that Q1 of counter 106 is connected to one input of AND gate 156. By selecting the other position of S6, Q2 is connected to AND gate 156. This position is selected in February during leap year, and will cause the counter 106 to advance to count 29 instead of 28. After February in leap year, S6 is returned to its normal position.

Switches S1, S2 and S3 are used for setting of counters 72, 98 and 106, respectively. When S1 is closed, counter 72 is advanced whenever count of Q4 of counter 66 changes state from low to high, or every 0.267 seconds. Likewise, same operation is applied to switches S2 and S3 causing counters 98 and 106 to advance at a rapid rate until desired setting has been achieved. When the desired settings have been achieved, the respective switches are restored to the normal open position. Resistors 73, 110 and 152 permit this wired OR function during time setting, providing isolation from the respective normal clock inputs.

Figure 6:
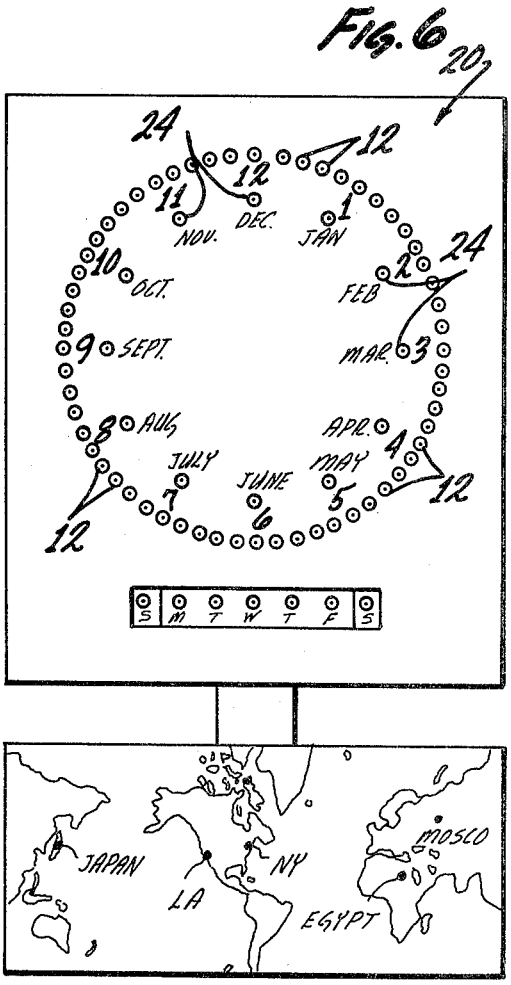
FIG. 6 is a partial showing of the switching circuit of the different time zone function of the electronic time piece of the instant invention.
Figure 5:
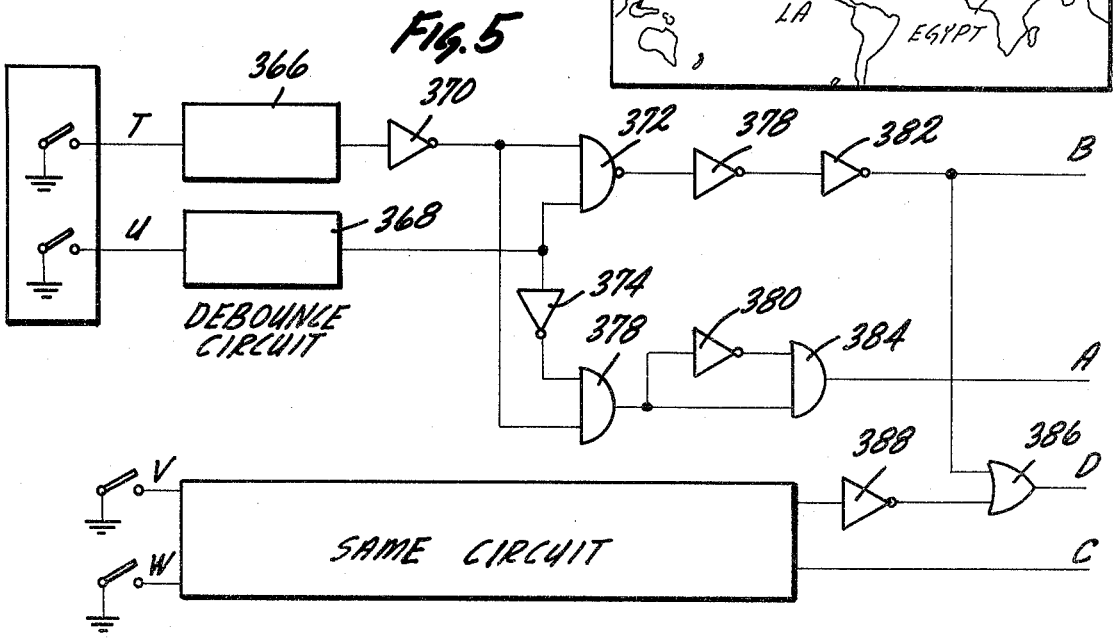
FIG. 5 is a partial schematic showing of the different time zone function of the electronic time piece of the instant invention.
Figure 7:
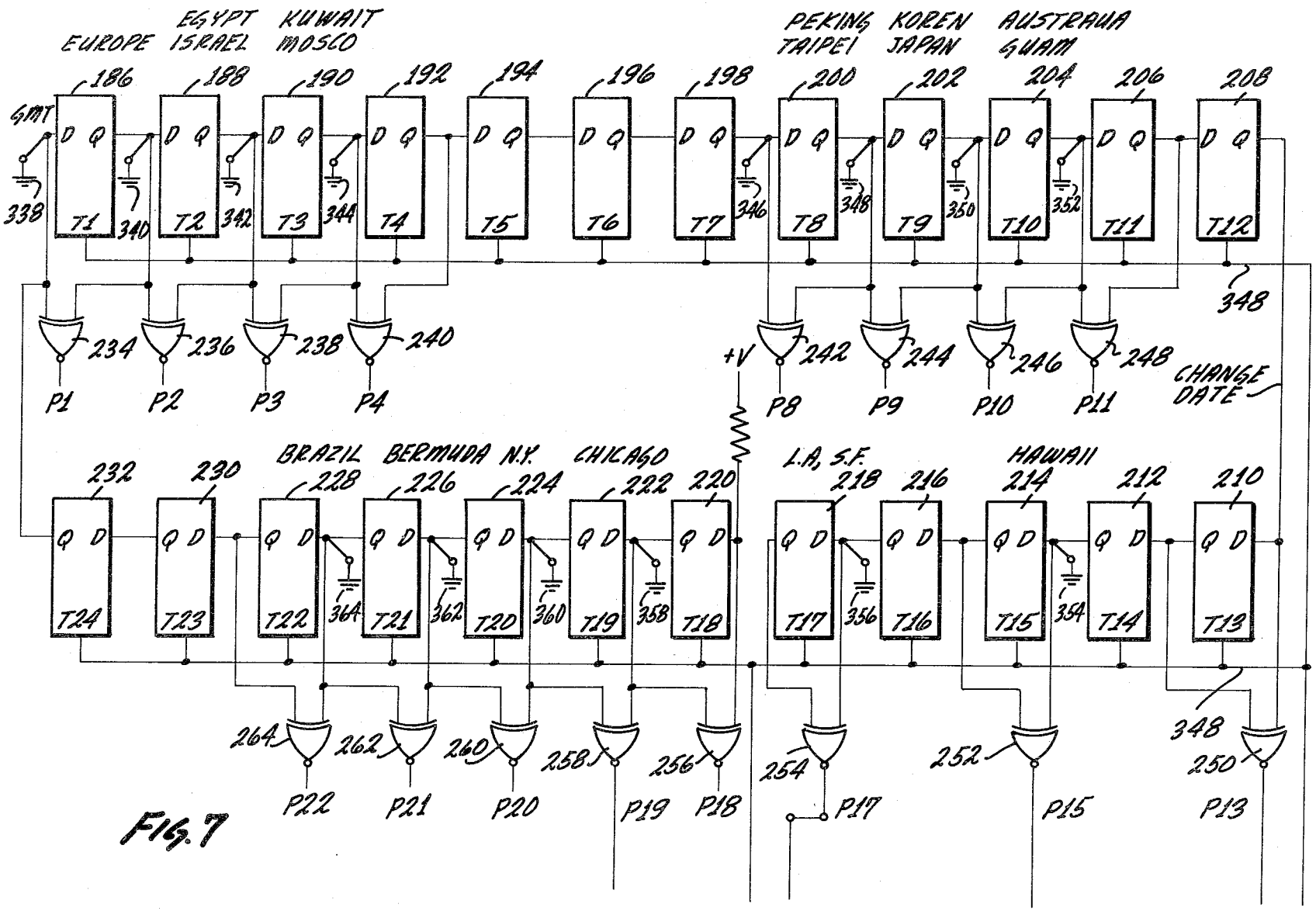
FIGS. 7 and 8 are showing of the logic circuit of the different time zone function of the electronic time piece of the instant invention.
Figure 8:
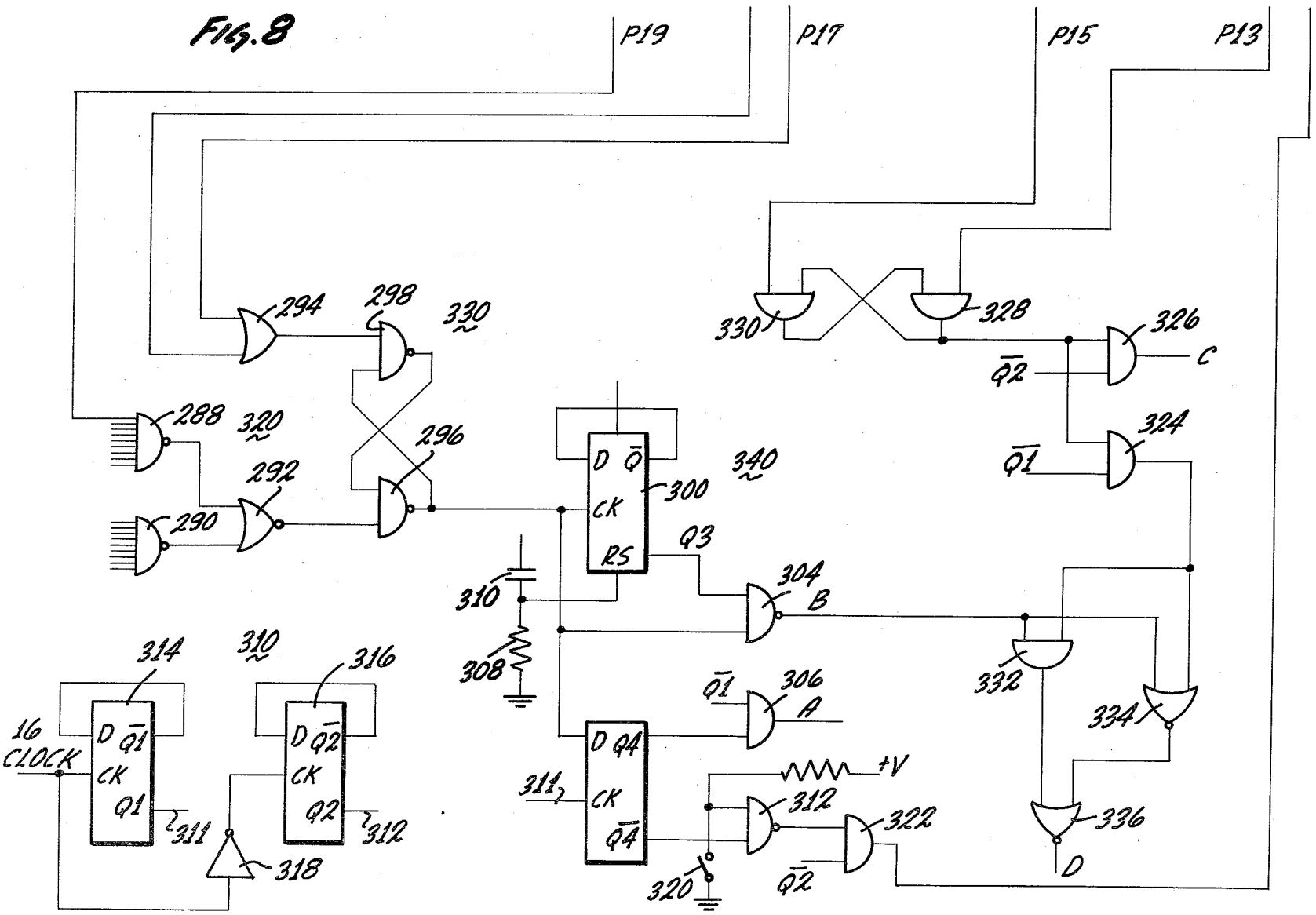

The device corresponding to the circuits shown in FIGS. 7 and 8 is generally utilized in a large clock, such as, that shown in FIG. 6 which has a remote world time selector. The device of FIGS. 7 and 8 may, however, be utilized in the wrist watch shown in FIG. 1, as hereinafter explained in detail.

Referring now to FIGS. 7 and 8 twenty-four D flip-flops are connected as a series shift register. Output Q of flip-flop 186 is connected to input D of flip-flop 188; whose output Q is connected to input D of flip-flop 190; whose output Q is connected to input D of flip-flop 192; whose output Q is connected to input D of flip-flop 194; whose output Q is connected to output D of flip-flop 196; whose Q is connected to input D of flip-flop 198; whose output Q is connected to input D of flip-flop 200; whose output Q is connected to input D of flip-flop 202; whose output Q is connected to input D of flip-flop 204; whose output Q is connected to input D of flip-flop 206; whose outut Q is connected to input D of flip-flop 208; whose output Q is connected to input D of flip-flop 210; whose output Q is connected to input D of flip-flop 212; whose output Q is connected to input D of flip-flop 214; whose output Q is connected to input D of flip-flop 216; whose output Q is connected to input D of flip-flop 218. Output Q of flip-flop 220 is connected to input D of flip-flop 222; whose output Q is connected to input D of flip-flop 224; whose output Q is connected to input D of flip-flop 226; whose output Q is connected to input D of flip-flop 228; whose output Q is connected to input D of flip-flop 230; whose output Q is connected to input D of flip-flop 232; whose output Q is connected to input D of flip-flop 186.

All above described flip-flops have a common connected clock to their respective input clock terminals. Sixteen Exclusive NOR gates 234 through 264 are connected as follows: The first input of exclusive NOR gate 234 is connected to D input of flip-flop 186. The second input of exclusive NOR gate 234 is connected to the output Q of flip-flop 186 and to the first input of exclusive NOR gate 236. The second input to exclusive NOR gate 236 is connected to the output Q of flip-flop 188, and to the first input of exclusive NOR gate 238. The second input to exclusive NOR gate 238 is connected to the output Q of flip-flop 190, and to the first input of flip-flop 240. The second input to exclusive NOR gate 240 is connected to the output Q of flip-flop 192.

The first input of exclusive NOR gate 242 is connected to the output Q of flip-flop 198. The second input of exclusive NOR gate 242 is connected to output Q of flip-flop 200, and to the first input of exclusive NOR gate 244. The second input to exclusive NOR gate 244 is connected to the output Q of flip-flop 202, and to the first input of exclusive NOR gate 246. The second input to exclusive NOR gate 246 is connected to output Q of flip-flop 204, and to the first input of exclusive NOR gate 248. The second input to exclusive NOR gate 248 is connected to the output Q of flip-flop 206. The first input to exclusive NOR gate 250 is connected to the output of flip-flop 208. The second input to exclusive NOR gate 250 is connected to the output Q of flip-flop 210. The first input to exclusive NOR gate 252 is connected to the output Q of flip-flop 212. The second input to exclusive NOR gate 252 is connected to the output Q of flip-flop 214. The first input to exclusive NOR gate 254 is connected to the output Q of flip-flop 216. The second input to exclusive NOR gate 254 is connected to output Q of flip-flop 218. The first input to exclusive NOR gate 256 is connected to input D of flip-flop 220, and to resister 268 whose other terminal is connected to positive voltage supply. The second input to exclusive NOR gate 256 is connected to output Q of flip-flop 220, and to the first input of exclusive NOR gate 258. The second input to exclusive NOR gate 258 is connected to the output Q of flip-flop 222, and to the first input of exclusive NOR gate 260. The second input to exclusive NOR gate 260 is connected to the output Q of flip-flop 224, and to the first input of exclusive NOR gate 262. The second input of exclusive NOR gate 262 is connected to the output Q of flip-flop 226, and to the first input to exclusive NOR gate 264. The second input to exclusive NOR gate 264 is connected to the output Q of flip-flop 228.

The outputs of exclusive NOR gates 234, 236, 238, 240, 242, 244, 246, and 248 are connected to the eight inputs of NAND gate 290 respectively. The outputs of exclusive NOR gates 250, 252, 254, 256, 258, 260, 262, and 264 are connected to the eight inputs of NAND gate 288 respectively. The output of NAND gate 290 is connected to the first input of NOR gate 292. The output of NAND gate 288 is connected to the second input of NOR gate 292. The common clock to the 24 D flip-flop is also connected to the first input of OR gate 294. The second input of OR 294 is connected to the output of exclusive NOR gate 254. Note that this connection is peculiar to the selection of time zone, and may be similarly connected to other outputs of exclusive NOR gates for different time zone as selected base. Likewise, the output of D flip-flop 218 is not connected to the D input of D flop-flop 220, thus breaking the chain with respect to the selected base; the D input of D flip-flop 220 being tied high through resistor 268. This break may be established at any time zone as desired as may be readily observed from the schematic diagram.

The output of OR gate 294 is connected to the first input of NAND gate 298. The output of NOR gate 292 is connected to the first input of NAND gate 296. The second input of NAND gate 298 is connected to the output of NAND gate 296. The second input of NAND gate 296 is connected to the output of NAND gate 298. The output of NAND gate 296 is connected to the clock input of D flip-flop 300, and to the D input of D flip-flop 302, and to the first input of NAND gate 304. The $\overline{Q}$ output of flip-flop 300 is connected to its D input. The reset input to flip-flop 300 is connected to resistor 308, and to capacitor 310. The other side of resistor 308 is connected to logic common, and the other side of capacitor 310 is connected to V+. Q output of flip-flop 300 is connected to the second input of NAND gate 304.

Flip-flop 314 has clock input from the 60 Hz square wave previously described in part I. This clock signal is also connected to the input of inverting gate 318. $\overline{Q}$ output of flip-flop 314 is connected to its D input. The output of inverting gate 318 is connected to the clock input of flip-flop 316. The $\overline{Q}$ output of flip-flop 316 is connected to its D input.

Output Q of flip-flop 314 is connected to the clock input of flip-flop 302. Output Q of flip-flop 302 is connected to the first input of AND gate 306. The second input to AND gate 306 is connected to $\overline{Q}$ output of flip-flop 314 and to the first input of AND gate 324. Output $\overline{Q}$ of flip-flop 302 is connected to the first input of NAND gate 312. The second input to NAND gate 312 is connected to resistor 318 and switch 320. The other side of resistor 318 is connected to V+. The other side of switch 320 is connected to logic common.

The output of NAND gate 312 is connected to the first input of NAND gate 322. The second input to NAND gate 322 is connected to output $\overline{Q}$ of flip-flop 316 and to the first input of AND gate 326. The second input to AND gate 324 is connected to the second input of AND gate 326 and to the output of NAND gate 328 and first input of NAND gate 330. The second input to NAND gate 330 is connected to the output of exclusive NOR gate 252. The output of NAND gate 330 is connected to the first input of NAND gate 328. The second input to NAND gate 328 is connected to the output of exclusive NOR gate 250. The output of AND gate 324 is connected to the first input of NOR gate 334, and to the first input of AND gate 332. The output of NAND gate 304 is connected to the second input of AND gate 332 and the second input of NOR gate 334. The output of NOR gate 334 is connected to the first input of NOR gate 336. The output of AND gate 332 is connected to the second input of NOR gate 336. The output signals from NAND gate 306, AND gate 304, NAND gate 326, NOR gate 336, NAND gate 324, provide the A, B, C, D, E signals respectively as hereinbefore discussed (see FIG. 1). The output of NAND gate 322 is the common clock to the 24 D flip-flops previously discussed.

For the following of the 24 D flip-flops described above, switches are connected from the D input terminal to common such as to provide a conductive path from the D terminal to logic common when the switch is pushed or energized; S338 is connected to the D input of flip-flop 186, S340 is connected to the D input of flip-flop 188, S342 is connected to the D input of flip-flop 190, S346 is connected to the D input of flip-flop 200, S348 is connected to the D input of flip-flop 202, S350 is connected to the D input of flip-flop 204, S352 is connected to the D input of flip-flop 206, S354 is connected to the D input of flip-flop 214, S356 is connected to the D input of flip-flop 218, S358 is connected to the D input of flip-flop 222, S360 is connected to the D input of flip-flop 224, S362 is connected to the D input of flip-flop 226, S364 is connected to the D input of flip-flop 228.

Each of the 24 D-type flip-flops along with its associated push button switch and its exclusive NOR gate as above described, represent a time zone. For the practical application, however, only the time zones of interest are shown with respect to the 24 flip-flops, such a number totaling 16. It should also be noted that in the user's local time zone, the appropriate D-type flip-flop has its Q output disconnected, and its associated exclusive NOR gate output is connected to the first input of NOR gate 294. Such a connection is shown as above described for the local time zone of Los Angeles/San Francisco in FIG. 2, where the Q output of D flip-flop 218 is disconnected from the D input of flip-flop 220, and where the output of exclusive NOR gate 254 is connected to the first input of NOR gate 294. The D input to flip-flop 220 is pulled up to a high state with resistor 268 as previously described.

Figure 3:
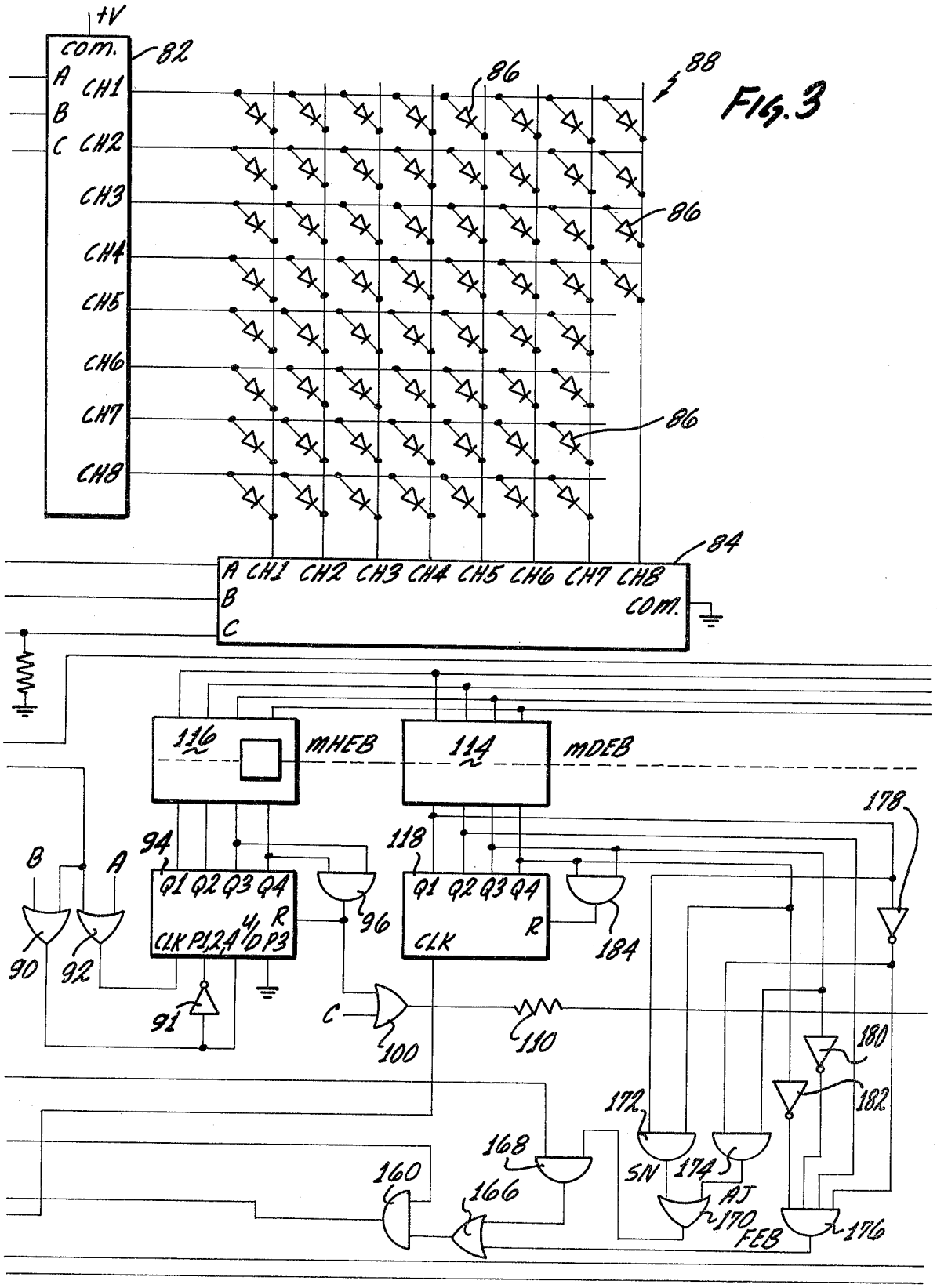
FIG. 3 is a partial schematic showing of the electronic time piece of the invention.
Figure 4:
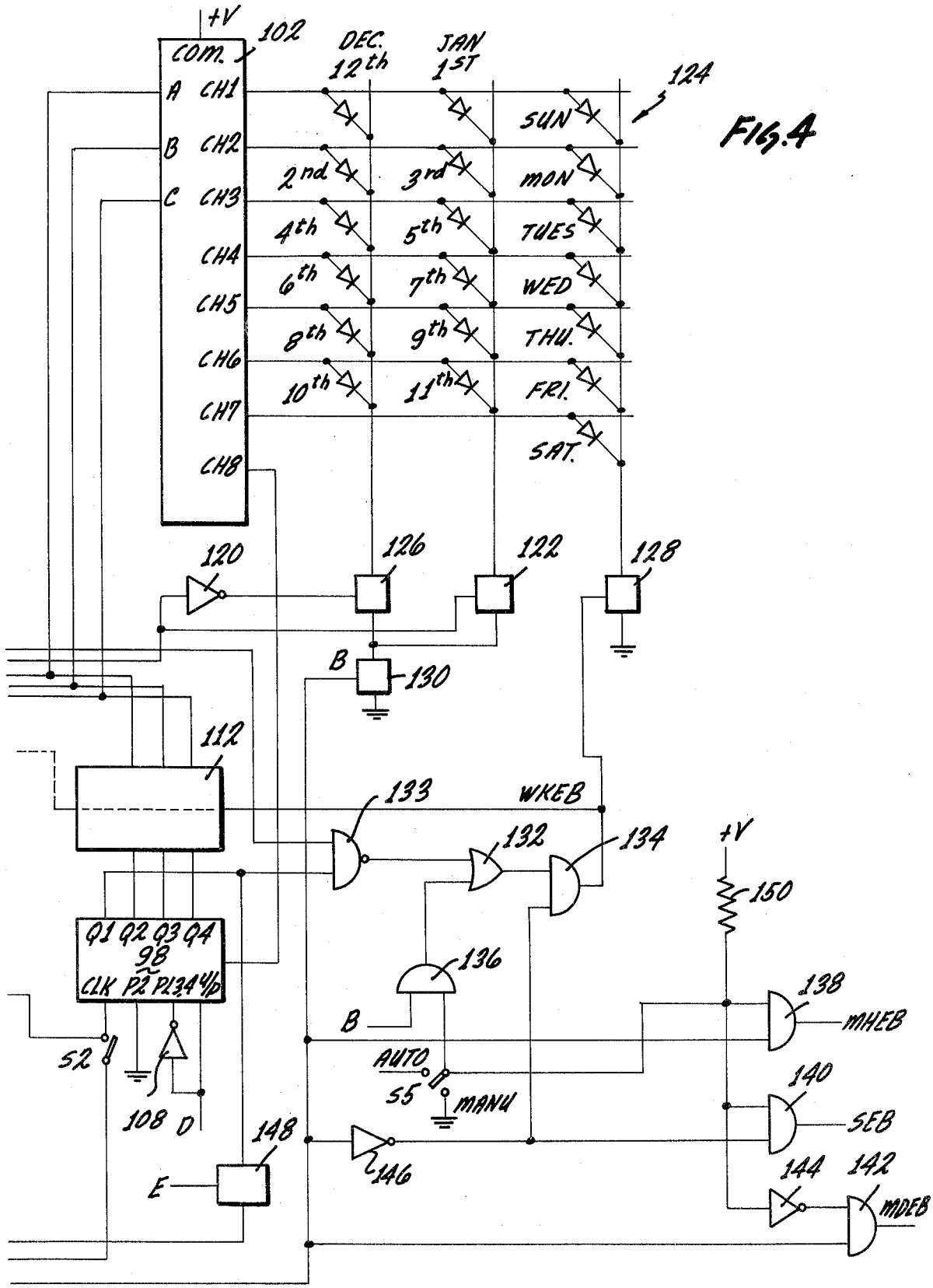
FIG. 4 is a partial schematic showing of the selective different time zone function of the electronic time piece of the invention.

The connections between FIG. 2 and FIG. 3 of the described circuits are as follows: The clock line described in FIG. 3 (the CLK input of counter 66) is common clock line to Part II; likewise, A is connected to A, B is connected to B, C is connected to C, D is connected to D, E is connected to E, and +V and logic common are connected between these two circuits, such as to connect the above described clock/calendar timepiece to the Push-Time keyboard circuit.

Consider the following state of the above described circuits for the purpose of functional description: All of the Q output of the 24 D-type flip-flops are initially in a high state; therefore also all exclusive NOR gates have high outputs.

The A, C, and E signal lines are in low states.

B and D signal lines are in high state.

To find the time and date in Tapei, for example, switch 348 is pushed. This causes the output of exclusive NOR gate 244 to have a low output. This causes the output of NAND gate 288 to have a high output. The high output level of NAND gate 288 causes the output of NOR gate 292 to have a low level output which therefore causes NAND gate 296 to have a high level output. This low-to-high transition output of NAND gate 396 causes the D flip-flop 300 to clock Q into a high state since previously this flip-flop was in a low state, thus presenting a high input level to NAND gate 304. The NAND gate 304 now has two high inputs, causing its output B to go to a low state.

Because the signal E to NOR gate 334 is initially in a low state, this NOR gate now has two low level inputs, causing its output to go to a high state. This high state input to NOR gate 336 causes its output to go to a low state. The following is therefore set in motion:

1. The up-down control to hour counter 94 is low causing this counter to be in the count-down mode.

Note that whenever the counter 94 is in the count-down mode, the preset inputs P1, P2, and P4 are all in HIGH state and P3 is permanently LOW, so that when the counter 94 is counting down to binary 0000 , which represents 12 o'clock. The counter is preset by the encoder 96 to binary 1011 or 11 o'clock.

2. A pulse train is generated at the output of NAND gate 322 which is applied to the clock input to the D flip-flop causing the low state of the activated switch 348 shifted down 9 D flip-flops and stopped at the selected local time zone's D flip-flop 218.

3. A separate pulse train consisting of eight clock-pulses is therefore generated at the output of AND gate 306 (or A) thereby causing the hour counter 94 to count down 8 hours. The contents of hour counter 94 now represents the time in Taipei.

4. The low state of the NOR gate 336's output, or D, causes the weekday counter 98 in the count-down mode, so that if the counting-down hours passes 12 o'clock, a clock pulse will be generated to decrease the week-day counter 98 for one bit, or 12 hours.

While switch 348 was depressed, the eight pulse clock signal was derived from the output of AND gate 306 in the following manner: The D input to D flip-flop 302 was in a high state as supplied by NAND gate 296. This state is clocked into the Q output of D flip-flop 302 thereby causing AND gate 306 to be permissive to its second input from D flip-flop 314, and NAND gate 322 to be permissive to its second input from D flip-flop 316. The output of AND gate 306 and NAND gate 322 therefore produce dock pulses to the 24 D flip-flop shift register and the hour counter 94, respectively, until the Q output of D flip-flop 302 returns to a low state. This occurs when its D input is returned to a low state following eight clock pulses which are applied to the 24 D flip-flops from the output of NAND gate 322. The low state on the D input to flip-flop 202 is shifted 9 D flip-flops until it reaches the local time zone D flip-flop 218 and causes exclusive NOR gate 254 to go to a low level on its output thereby resetting the output of NAND gate 298 to a high level. This causes the output of NAND gate 296 to revert to a low level thereby disabling AND gate 306 and NAND gate 322 through D flip-flop 302. During this shift, each exclusive NOR gate affected will be in a low state output for one period of the clock signal applied to the 24 D flip-flops. The whole shifting and clocking process are terminated at the selected local time zone.

At the end of the eight clock pulses, B is returned to a high state, thus resulting in a high level on the up-down control of hour counter 94 and corresponding low levels at its preset inputs P1, P2, and P4. This counter is therefore returned to a normal count-up mode while switch 348 is stilldepressed. At the same time D is also returned to a high state so that the week-day counter 98 is back to the normal count-up mode.

Upon the release of switch 348, the high input on the up-down control of hour counter 94 and weekday counter 98 remains high thereby leaving these counters in the count-up mode. Again, eight clock pulses are received from AND gate 306, advancing the hour counter 94 to its original local time. Also the output of NOR gate 336 is now in a high state, the weekday counter 98 which might have been deincremented in the above, if the eight hour time difference included a date difference, would now be advanced to local date again, thus restoring local time and date upon the release of switch 348.

When switch 348 was released again exclusive NOR gate 244 goes to a low state on its output, and activates the same eight pulse clock signal, now a high state is shifted from the D input of flip-flop 202 to the output of D flip-flop 218 so that the low output of exclusive NOR gate 254 again causes AND gate 306 to be disabled.

D flip-flop 210 represents the international date change zone. NAND gates 330 and 328 are connected as a latch such that when switch 348 is pushed, and this low state passes D flip-flop 210, a low pulse is generated at the output of exclusive NOR gate 250. This low pulse causes the output of NAND gate 328 to go to a high state. The high input to AND gate 324 causes its output to go to a high state whenever its second input Q is high as determined by the clock input to D flip-flop 314.

The high state on the output of AND gate 324 causes the output of NOR gate 334 to go to a low state. Because the output from NAND gate 304 is in a low state, NOR gate 336 now has two low inputs thereby causing its output to go to a high state. Likewise, the output of AND gate 326 gate will be in a high state whenever its second input is high as derived from the output Q of D flip-flop 316 clocked by the inverted clock of D flip-flip 314. The latch comprising AND gates 330 and 328 is reset by the output from exclusive NOR gate 252. The output of AND gate 326 is therefore a pulse-train consisting of two pulses causing the weekday counter 98 to count up twice thereby advancing this counter two 12 hour increments, or one day. The same takes place when switch 348 is released, resulting in the weekday counter being deincremented by two 12 hour counts, thereby restoring the date to local time since now the updown signal to weekday counter 98 is low.

It may be understood that the above is only an example for purpose of circuit description, and that similar results resulting in different number of clock pulses will be obtained by pushing different time zone switches.

Referring now to FIG. 2, which is the Dial-Time logic for the watch timing device when the timing device is in the form of a watch, the power supply circuit (40 through 54) will be replaced by a battery, and the 1 Hz source (56, 66, and 68) will be replaced by a crystal and its associated dividing circuit, the as same as most of today's DIGITAL WATCHES. The watch has a ring which can be rotated clockwise or counter-clockwise. Inside the ring are 24 conductors grounded to the bezel which is also the logic ground. Each grounded conductor represents a time zone in the world as indicated on the outside of the ring. If the dial is rotated one way, the sequence of switch closures T, U will be respective to the direction of rotation. Input T is connected to circuit 336 which is a debounce filter or circuit which eliminates multiple transitions of leading or trailing edges of the pulse as a result of switch bounce. The output of 366 is connected to inverting gate 370. The output of inverting gate 370 is connected to one input of NAND gate 372, and to one input of AND gate 376. Input U is connected to debounce circuit 368 which is of same type as 366. The output of debounce circuit 368 is connected to the second input of NAND gate 372, and to the input of inverting gate 374. The output of inverting gate 374 is connected to the second input of AND gate 376. The output of AND gate 376 is connected to one input of AND gate 384 and to the input of inverting gate 380, whose output is connected to the second input of AND gate 384. The output of AND gate 384 is connected to the second input of OR gate 92 in Part I or FIG. 1. The output of NAND gate 372 is connected to the input of inverting gate 378. The output of inverting gate 378 is connected to the input of inverting gate 382. The output of inverting gate 382 is connected to the second input of AND gate 136 and the second input of OR gate 90, and to one input of OR gate 386.

Inputs V and W are connected to an identical circuit as described above, and its output C is connected to the second input of OR gate 100. The second outout is connected to inverting gate 388. The output of inverting gate 388 is connected to the second input of OR gate 386. The output of OR gate 386 is connected to the input of inverting gate 108 and to the up/down control of counter 98. If the dial ring is rotated clockwise, the contact in respective time zones will make connection with T first, then U, and a low signal is presented to inverting gate 370 producing a high level on its output. NAND gate 372 now has two high inputs, and produces a low output on B through inverting gates 378 and 382. When U makes connection, a low input to NAND gate 372 causes its output to go high, and output of inverting gate 374 to go high. AND gate 376 now has two high inputs causing its output to be high producing an output pulse A at the output of AND gate 384 of duration equal to the propagation delay through inverting gate 380, since B is delayed by the inverter 378 and 382, B is remain low at the pulse A. Pulse A is the clock input to hour counter 94. Therefore the hour counter is decreased one hour by the pulse A while clockwise rotation of the dial ring takes place since B is in a low state causing hour counter 94 to operate in a count-down mode. If a counter-clockwise rotation takes place, then U will make connection before T and the reverse will take place. The input T is high causing a low input to NAND gate 372 through inverting gate 370. Output B is therefore high through inverting gates 378 and 382, and counter 94 is in the up count mode. When U makes connection a low input to inverting gate 374 causes a high input to AND gate 376. When T now makes connection a second high input to AND gate 376 produces a pulse output A of as previously described causing counter 94 to advance a count.

An additional conductor is located on the inside of the previously discussed 24 zone conductors. This is the date change conductor. When the dial ring is rotated so that the date change conductor passes the inputs V and W, V and W are sequentially grounded in a fashion as previously discussed with respect to U and T. One pulse is generated at the output C with either high or low state at output D of OR gate 386 depending upon the direction of rotation of the bezel ring. A clockwise rotation results in deincrementing the hour and incrementing the date on counters 94 and 98 respectively. A counter-clockwise rotation will increment the hour counter 94 and deincrement the date counter 98.

Having described the invention in connection with certain specific embodiments thereof, it is not to be understood that further modifications may now suggest themselves to those skilled in the art and it is intended to cover such modifications as fall within the scope of the appended claims.

What is claimed is:

1. An electronic timepiece having a horologic display comprising:

a first plurality of identical single individual display elements arranged in conventional analog clock minute-second sequence;

a second plurality of identical single individual display elements arranged in conventional analog clock hour sequence;

a timing means;

logic means controlled by said timing means connected to said display elements for alternately producing the minute and second indications at conventional analog clock locations each indication producing a steady state appearance on said first plurality of individual display elements and said logic means producing hour indications having a steady state appearance on said second plurality of individual display elements;

first means for selectively cancelling said minute and second indications and displaying the date of the month indication in place thereof at a corresponding numbered minute location; and second means for selectively cancelling said hour indications and displaying the month number indication in place thereof at a corresponding numbered hour location.

2. The invention as defined in claim 1, additionally comprising a third plurality of individual analog display elements connected to said logic means for producing day of the week indications.

3. The invention as defined in claim 1, wherein said first plurality of individual display elements number sixty and said second plurality of individual display elements number twelve.

4. The invention as defined in claim 2, wherein said third plurality of individual display elements number seven.

5. The invention as defined in claims 1 or 2, wherein said individual display elements are liquid crystal displays.

6. The invention as defined in claims 1 or 2, wherein said individual display elements are light emitting diodes.

7. The invention as defined in claims 1 or 2, wherein said individual analog display elements are light producing means.

8. The invention as defined in claim 2, wherein said logic means further provides the indicating display element of said third plurality of individual analog display elements with AM and PM indication signals.

9. The invention as defined in claims 1 or 2, wherein additional means is provided for a high speed advance of a selected portion of said logic means for displaying a selected indication on said plurality of individual display elements.

10. The invention as defined in claim 1, wherein, said timing means comprises a reference frequency.

11. The invention as defined in claim 10, wherein, said reference frequency is 60 Hz derived from a 60 Hz convenience outlet.

12. The invention as defined in claim 10, wherein said reference frequency is 50 Hz derived from a 50 Hz convenience outlet.

13. The invention as defined in claim 10, wherein said reference frequency is derived from a crystal controlled oscillator.

14. The invention as defined in claims 1 or 2, wherein said logic means comprises a seconds, minutes, hours, days, date and month counters interconnected to a switching means for properly alternating and sequencing said plurality of individual analog display elements.

15. The invention as defined in claim 14, wherein said switching means comprises a demultiplexer means and a time sharing means for alternately displaying seconds and minutes.

16. The invention as defined in claims 1 or 2, further comprising a means for manually selecting any one of the twenty-four world time zones and displaying approximate information in relation thereto on said plurality of individual elements.

17. The invention as defined in claim 1, wherein said logic means further comprises control means for controlling said first means for periodically alternating between displaying minute and second indications and date of the month indications.

18. The invention as defined in claim 1, wherein said logic means further comprises control means for controlling said second means for periodically alternating between displaying the hour and the month indications.

19. The invention as defined in claim 1, wherein said logic means further comprises control means for controlling said first and second means for periodically alternating between displaying minute and second indications and date of the month indications and displaying hour and month indications.

20. The invention as defined in claim 19, wherein the date and month will be displayed three times a minute for a four second period and the second, minute and hour will be displayed at all other times.

* * * * *